United States Patent [19]

Jeremijevic

[11] Patent Number: 4,634,252

[45] Date of Patent: Jan. 6, 1987

[54] DEVELOPMENT INSTALLATION AND STORAGE DEVICE FOR ELECTROSTATIC PRINTER USING A LIQUID DEVELOPER

[75] Inventor: Vojin Jeremijevic, Montreuil, France

[73] Assignee: Benson, S.A., Creteil, France

[21] Appl. No.: 681,519

[22] Filed: Dec. 14, 1984

[30] Foreign Application Priority Data

Dec. 16, 1983 [FR] France ..... 83 20223

[51] Int. Cl.[4] ..... G03D 3/02; G03G 15/10

[52] U.S. Cl. ..... 354/324; 355/10; 222/82; 222/143; 222/145

[58] Field of Search ..... 354/324, 325; 355/10; 222/82, 83, 136, 143, 145, 129, 541

[56] References Cited

U.S. PATENT DOCUMENTS

| | | | |
|---|---|---|---|
| 2,826,338 | 3/1958 | Davis | 222/129 |
| 3,650,196 | 3/1972 | Hosoe et al. | 354/324 |
| 3,712,203 | 1/1973 | Kishi et al. | 355/10 |
| 3,760,986 | 9/1973 | Castner et al. | 222/145 |
| 4,111,304 | 9/1978 | Lucas | 206/459 |
| 4,119,989 | 10/1978 | Carvalko et al. | 354/324 |
| 4,197,942 | 4/1980 | Gacki et al. | 222/83 |

FOREIGN PATENT DOCUMENTS

| | | | |
|---|---|---|---|
| 58-192037 | 11/1983 | Japan | 354/324 |

*Primary Examiner*—A. A. Mathews

*Attorney, Agent, or Firm*—Ladas & Parry

[57] ABSTRACT

A development installation and storage device for an electrostatic printer which uses liquid developer is provided. The device includes a removable reservoir having a first compartment for liquid developer and a second compartment for concentrate of the liquid developers, the two compartments being separated by a wall and having respective openings adjacently disposed on each side of the wall. A connector on the reservoir connects the development station of the electrostatic printer with the first and second compartments through the respective openings, and a closing member is removably attached to the connector for tightly insulating the first and second compartments during transportation of the reservoir.

12 Claims, 5 Drawing Figures

DEVELOPMENT INSTALLATION AND STORAGE DEVICE FOR ELECTROSTATIC PRINTER USING A LIQUID DEVELOPER

DESCRIPTION OF THE INVENTION

The present invention relates to a development installation for an electrostatic printer using a liquid developer and a concentrate, and to a storage device for those products for the development.

In printers of this type, a developer is used which comprises a mixture of particles and liquid, e.g., a mixture of electrically charged micro-particles of carbon in suspension in kerosine.

It is usual for the developer to be contained in a supply near the bottom of the printer and for the toner to be brought from the supply to a developing station and then returned to the supply by circulating the developer round a loop circuit.

As the printer is used, the quantity of particles contained in the developer diminishes, i.e., the mixture becomes relatively diluted.

The use of a highly volatile liquid, such as kerosine, reduces this dilution to some degree.

However, it is generally necessary to have a supply of concentrate available in order to restore the proper concentration of particles in the liquid, in particular for compensating high rates of particle consumption when very black printing is required.

The concentrate is likewise a mixture of particles and liquid, but with a much lower proportion liquid than in the developer. By way of example, the developer may be obtained by diluting one volume of concentrate in about one hundred volumes of liquid.

Systems exist for automatically detecting the concentration of toner in the developer and for controlling the addition of quantities of concentrate as necessary. It is conventional to detect toner concentration either optically or else by measuring an electrical characteristic of the developer.

In such prior art systems, when it is necessary to add concentrate, the concentrate is taken from a concentrate tank situated in the printer and is injected into the developer circuit. A special circuit is then generally provided between the concentrate tank and a point on the developer circuit, and in some cases an additional chamber is inserted therein. Reference may be made in particular to U.S. Pat. Nos. 3,650,196 and 4,119,989.

SUMMARY OF THE INVENTION

An object of the present invention is to provide a development installation which is simpler and therefore cheaper than those of the prior art, while insuring an easy replacement of the storage device of the products necessary for the development. Another object of the invention is to provide a storage device for the products for the development of an electrostatic printer in which the risk of involuntary use of a concentrate which is not compatable with the developer is reduced.

According to the invention, a development installation for an electrostatic printer comprises:

a removable reservoir having first and second separate compartments for the liquid developer and for the concentrate, said compartment having first and second openings adapted to be closed by closing means for tightly insulating each of said compartments during the transportation of the liquid developer and concentrate in said reservoir;

first means for circulating the liquid developer between said first compartment and a developing station; and second means for selectively circulating concentrate from said second compartment to said first compartment; and connecting means attached to said first and second circulating means and removably connectable to said reservoir for communicating said first circulating means with said first compartment, and said second circulating means with said second compartment, through said openings.

According to another aspect of the invention, a storage device for the development installation of an electrostatic printer comprises:

a one-piece reservoir including first and second compartments separated by a wall, said first and second compartments having first and second openings disposed adjacent on each side of said wall; a connecting member on said reservoir for connecting the development installation of said electrostatic printer with said first and second compartments through said openings; and a first closing member removably attached to said connecting member for tightly insulating said first and second compartments during the transportation of said liquid developer and said concentrate in said first and second compartments.

BRIEF DESCRIPTION OF THE FIGURES

Other features and advantages of installations and devices in accordance with the invention appear on reading the following description which is given by way of non-limiting example with reference to the accompanying drawings, in which.

DESCRIPTION OF THE PREFERRED EMBODIMENTS

Figure 1:
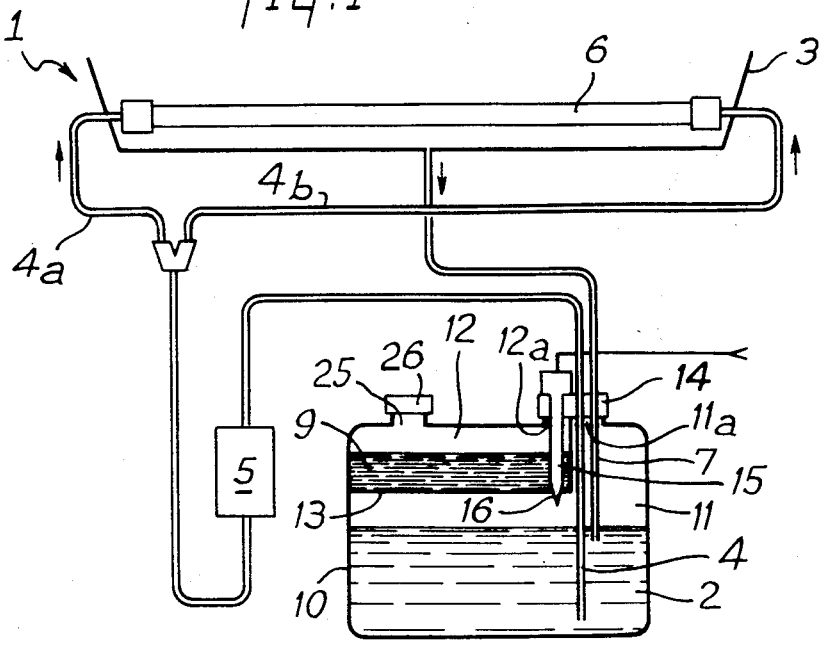
FIG. 1 is a diagrammatic view of an installation in accordance with the invention.

The developer is taken from a supply 2 to a developing trough 3 in the station 1. Excess developer is returned from the trough 3 to the supply 2, with continuous developer circulation being set up during printer operation. An inlet circuit comprises a tube 4 with one end dipped in the supply 2, a pump 5, and with its other end in the form of a fork having first and second branches **4*a* and 4*b* leading to respective ends of a tube 6 which extends along the trough 3. In a conventional manner, the developer is projected from the tube 6 through perforations running along the length thereof, and is then picked up in corrugations on a rotary roller (not shown) for depositing charged particles on a print medium which is moved in contact with the corrugated roller. Excess developer is picked up by the trough, whence it is returned to the supply 2 under gravity flow by means of a return tube 7 connecting an orifice in the bottom of the trough 3 to the supply 2**.

A supply of concentrate 9 is provided so that the developer circulating through the printer can be recharged as required.

In accordance with the invention, the supplies of developer and concentrate are situated in respective adjacent compartments 11 and 12 which are capable of communication with each other via a connection passing through the wall 13 which separates them.

Figure 2:
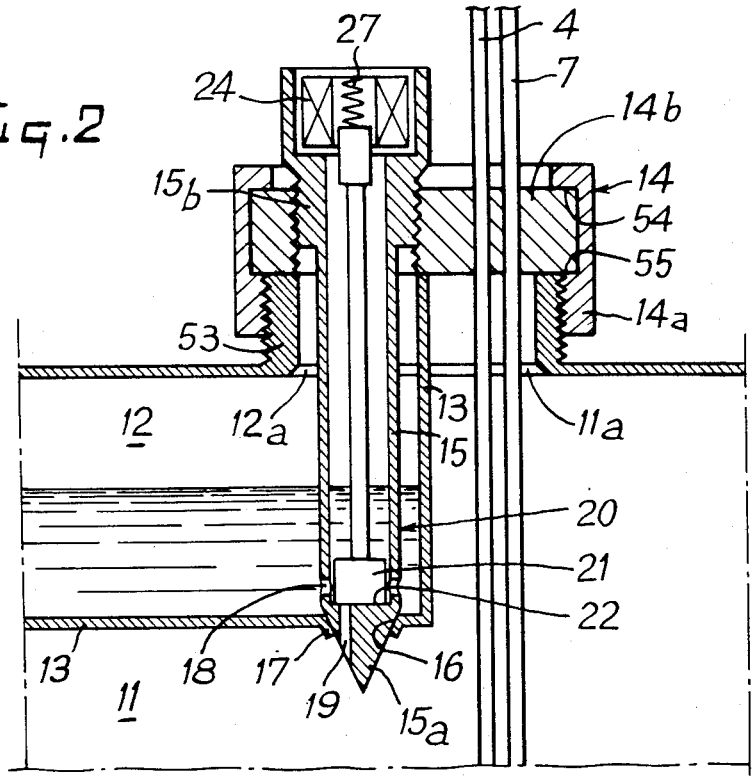
FIG. 2 is a section on a larger scale through a portion of a tank containing the supplies of concentrate and developer in the FIG. 1 installation.

FIGS. 1 and 2 show the compartments 11 and 12 as being integrated in a single tank 10, e.g., made up from two molded or thermo-formed symmetrical half shells made of a plastic such as a polyurethane or a polyethylene.

The tank 10 is normally delivered to the customer with both its compartments 11 and 12 filled with supplies of their respective liquids.

The compartment 12 occupies a portion of the top of the tank 10. The compartments 11 and 12 have respective adjacent openings ll*a* and 12*a* surrounded by a threaded neck 53 and closed by a single stopper or plug 14. This stopper comprises an annular threaded portion 14*a* which is screwed on the threaded neck 53 of the tank 10. The stopper 14 also includes a circular middle portion 14*b* rotatably mounted in the annular portion 14*a* and prevented from moving axially in this annular portion by shoulders 54 and 55. The middle portion 14*b* is traversed by tubes 4 and 7 which extend into compartment 11. This arrangement in two parts 14*a*, 14*b* of the stopper 14 makes it possible to screw the annular portion 14*a* without rotating tubes 4 and 7, until this annular portion engages the neck 53 and the wall 13.

The compartment 12 occupies a portion of the top of the tank 10. The compartments 11 and 12 have respective adjacent openings ll*a* and 12*a* which are closed by a single stopper 14. The stopper 14 has the tubes 4 and 7 passing therethrough to reach the compartment 11.

The connection between the compartments 11 and 12 is made via a tube 15 which includes a valve 20 and which passes in a sealed manner through a orifice 16 in the bottom portion of the wall 13 (which is horizontal in the example illustrated).

Advantageously, the tube 15 has a pointed conical bottom end 15*a* with the orifice 16 being formed by the pointed end perforating the wall 13 as the tube 15 is installed.

The tube 15 may have a threaded portion 15*b* which is screwed into place in the stopper 14. The wall 13 is perforated when screwing the stopper 14, this movement displacing downwardly the middle portion 14*b*, and the tube 15. It can be seen that the material around the rim of the opening 16 forms a lip 17 which, after perforation, presses against the periphery of the tube 15, thereby ensuring sealing. The internal volume of the tube 15 is in communication with the bottom of the interior of the compartment 12 via one or more side orifices 18. The bottom end of the tube 15 projecting into the compartment 11 is of reduced cross section and forms a slightly off-centered passage 19 which opens out into the compartment 11.

The communication path between the compartments 11 and 12 which passes via the orifice(s) 18, the tube 15, and the passage 19 is opened and closed by the valve 20. The valve 20 includes a shutter 21 which cooperates with a seat 22 that surrounds the top of the passage 19. The shutter 21 is at the bottom end of a rod whose top end either constitutes or is fixed to the core of an electromagnet 24 which is fixed to the tube 15 outside the tank 10. The winding of the electromagnet 24 is connected to the output from a circuit (not shown) which responds in known manner to the detection of a shortage of toner particles in the developer or to a request for blacker printing to produce a signal to control the addition of concentrate to the developer. When the electromagnet 24 is excited, the shutter 21 is moved upwards, thereby establishing communication between the compartments 12 and 11 for the duration of the exciting signal. The concentrate flows under gravity into the compartment 11. As soon as the electromagnet 24 is no longer excited, the shutter 21 returns, under the thrust of a return spring 27, to a position in which it closes the passage 19.

Preferably the compartment 12 has only one opening 12*a*. However, for some applications, this compartment may include an additional opening 25 which is closed by a removable stopper 26 to be refilled, if necessary, without having to remove the stopper 14 which would also remove the tube 15.

Figure 3:
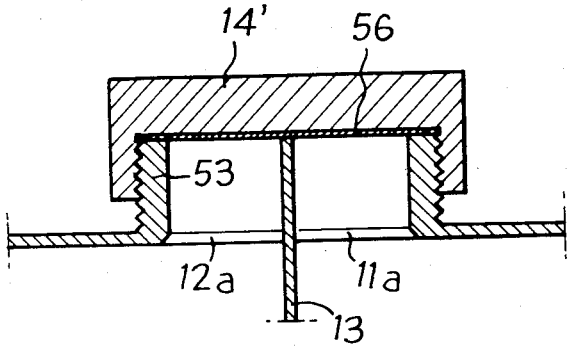
FIG. 3 is a section on a larger scale through a portion of the tank in FIG. 2 before it is installed in the installation shown on FIG. 1.
Figure 4:
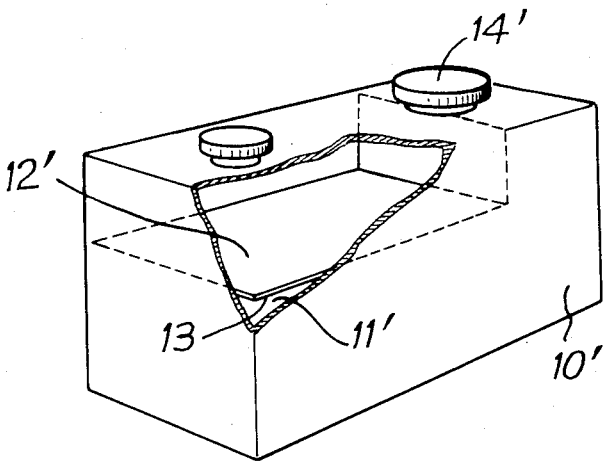
FIGS. 4 and 5 are perspective views of storage devices in accordance with the invention.

When necessary, the tank 10 is replaced by a new identical tank 10' as shown in FIG. 4. The new tank is prefilled with supplies of concentrate and developer in its compartments 11' and 12' which are isolated from each other by the wall 13'. During transportation of this tank, adjacent openings 11*a*, 12*a* (FIG. 3) of these compartments are tightly closed by a thin aluminum sheet 56 which is sealed on the upper surface of neck 53 and wall 13, then covered by a stopper 14' screwed on the neck 53. When the tank 10' is installed in the printer, the stopper 14' is replaced by the stopper 14 traversed by the tubes 4, 7 and 15. During this stage, tubes 4, 7 and 15 are forced through the aluminum sheet.

A single-piece, two-compartment tank such as the tanks 10 and 10' constitutes a preferred implementation of a storage device in accordance with the invention because of the advantages that result therefrom: simplified packaging; simplified transport; simplified inventory control of concentrate and developer; and a guarantee that the user will have a concentrate and a developer that are compatable with each other.

So far the description has been in terms of monochrome printers.

Figure 5:
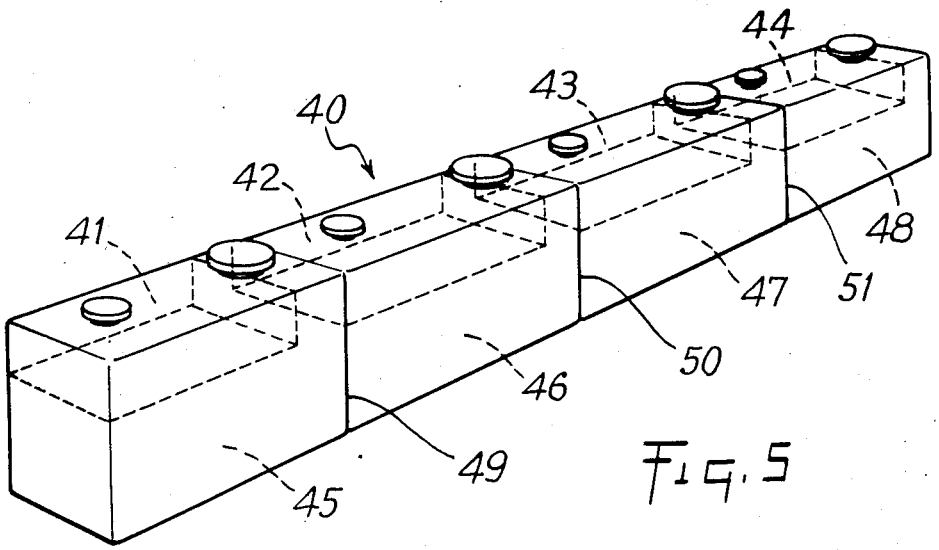

However, the invention is also applicable to color printers using two or more different colored liquid-borne toners. The various developer circuits then need to be associated with corresponding pairs of adjacent compartments containing the corresponding concentrates and developers, together with suitable means for making connections through the walls separating the pairs of compartments. Advantageously, all the pairs of compartments are formed in a single-piece tank such as the tank 40 shown in FIG. 5.

This tank is intended for a polychrome electrostatic printer (i.e., three primary colors plus black). It comprises four concentrate compartments 41, 42, 43, and 44 placed over four respective developer compartments 45, 46, 47, and 48. Adjacent pairs of compartments are separated by vertical walls 49, 50 and 51. Each pair includes a concentrate tank and a developer tank, in the same disposition as shown for the tanks 10 and 10' of FIGS. 1 to 3. The tank 40 is thus connected to each of four developer circuits in the manner described above with reference to the tanks 10 and 10'.

I claim:

1. A development installation for an electrostatic printer using a liquid developer and a concentrate comprising:

a reservoir having first and second separate compartments for the liquid developer and for the concentrate, said reservoir having first and second openings adapted to be closed by first closing means for tightly insulating each of said compartments during the transportation of the liquid developer and concentrate in said reservoir;

first means for circulating the liquid developer between said first compartment and a developing station; and second means for selectively circulating concentrate from said second compartment to said first compartment; and second closing means substitutable for said first closing means and attachable to said first and second circulating means and removably connectable to said reservoir for communicating said first circulating means with said first compartment, and said second circulating means with said second compartment, through said openings.

2. An installation according to claim 1, wherein said reservoir is removable from said development installation as a unit and comprises a tank including a wall separating said two compartments.

3. An installation according to claim 2, wherein said openings are adjacent and located on each side of said wall, said first closing means comprising a first closing member for closing said first and second openings, and said second closing means comprising a second closing member traversed by access means for communicating said first and second circulating means with said first and second compartments.

4. An installation according to claim 3, wherein said second closing means comprises a tube passing in sealed manner through the separating wall between the compartments, said tube including at least one first orifice putting the interior of the tube in communication with the second compartment and at least one second orifice putting the interior of the tube in communication with the first compartment, said second circulating means comprising a valve situated in the interior of the tube for establishing and for interrupting communication between the said first and second orifices.

5. An installation according to claim 4, wherein said tube is removably installed through the separating wall by perforating the separating wall with one end of the tube.

6. An installation according to claim 5, wherein said tube is removably fixed to said second closing means.

7. A storage device for a liquid developer and a concentrate for the development installation of an electrostatic printer having a connecting member adapted for connecting the development station to a source of liquid developer and concentrate, the storage device comprising:

a unitary reservoir including first and second compartments separated by a wall, said first and second compartments having first and second openings disposed adjacent on each side of said wall;

receiving means for receiving said connecting member to provide communication between said development installation and said first and second compartments through said openings; and a first closing member removably attached to said connecting member for tightly insulating said first and second compartments during the transportation of said liquid developer and said concentrate in said first and second compartments.

8. A storage device according to claim 7, wherein said connecting member is adapted to receive a second closing member which is part of the electrostatic printer, said closing member having access means for communicating the development installation of said electrostatic printer with said first and second compartments through said openings.

9. A storage device according to claim 8, wherein said wall is adapted for perforation by a tube member introduced through one of said openings for establishing a communication between said first and second compartments through said wall.

10. A storage device according to claim 9, wherein said second closing member is designed for contacting said wall to prevent communication from the first to the second compartment through said openings.

11. A storage device according to claim 7, for an electrostatic printer using a plurality of liquid developers, comprising a plurality of compartments for each said liquid developers and a corresponding plurality of compartments for concentrate, each compartment of concentrate being adjacent to a corresponding compartment of liquid developer.

12. A device according to claim 11, wherein each compartment of concentrate has a first opening adjacent to a second opening of the corresponding compartment of liquid developer, each such pair of first and second openings being closed by a respective common stopper.

* * * * *